US011417967B2

(12) United States Patent
Murray et al.

(10) Patent No.: US 11,417,967 B2
(45) Date of Patent: Aug. 16, 2022

(54) ELECTRICAL POWER CONNECTION DEVICE

(71) Applicant: COMMSCOPE TECHNOLOGIES LLC, Hickory, NC (US)

(72) Inventors: David Patrick Murray, Bristol (GB); Christopher Charles Taylor, Cheltenham (GB)

(73) Assignee: CommScope Technologies LLC, Hickory, NC (US)

( * ) Notice: Subject to any disclaimer, the term of this patent is extended or adjusted under 35 U.S.C. 154(b) by 141 days.

(21) Appl. No.: 16/625,432

(22) PCT Filed: Jun. 20, 2018

(86) PCT No.: PCT/US2018/038450
§ 371 (c)(1),
(2) Date: Dec. 20, 2019

(87) PCT Pub. No.: WO2018/236969
PCT Pub. Date: Dec. 27, 2018

(65) Prior Publication Data

US 2021/0280993 A1 Sep. 9, 2021

Related U.S. Application Data

(60) Provisional application No. 62/522,305, filed on Jun. 20, 2017.

(51) Int. Cl.

| | |
|---|---|
| ***H01R 4/2445*** | (2018.01) |
| ***H01R 4/2433*** | (2018.01) |
| ***H01R 12/51*** | (2011.01) |

(52) U.S. Cl.
CPC ..... *H01R 4/2445* (2013.01); *H01R 4/2433* (2013.01); *H01R 12/515* (2013.01)

(58) Field of Classification Search
CPC ... H01R 4/2445; H01R 12/515; H01R 4/2433
See application file for complete search history.

(56) References Cited

U.S. PATENT DOCUMENTS

| | | | | |
|---|---|---|---|---|
| 4,192,570 A * | 3/1980 | Van Horn | ..... | H01R 4/245 439/402 |
| 4,326,767 A | 4/1982 | Silbemagel et al. | | |
| 4,679,881 A | 7/1987 | Galvin et al. | | |
| 4,822,298 A | 4/1989 | Gerke et al. | | |
| 5,147,217 A * | 9/1992 | Neale, III | ..... | H01R 4/2433 439/403 |

(Continued)

FOREIGN PATENT DOCUMENTS

JP 2014-098806 A 5/2014

OTHER PUBLICATIONS

Extended European Search Report for European Patent Application No. 18820265.9 dated Feb. 3, 2021, 9 pages.

(Continued)

*Primary Examiner* — Jean F Duverne
(74) *Attorney, Agent, or Firm* — Merchant & Gould P.C.

(57) ABSTRACT

Aspects of the present disclosure relate to an electrical connection device having features for cutting an electrical power conductor while maintaining downstream continuity and limiting access to the electrical power conductor.

21 Claims, 10 Drawing Sheets

(56) References Cited

U.S. PATENT DOCUMENTS

| | | | | |
|---|---|---|---|---|
| 8,481,868 | B2 * | 7/2013 | Dennes | H01R 4/2433 174/549 |
| 11,056,802 | B2 * | 7/2021 | Hata | H01R 11/01 |
| 2010/0155135 | A1 * | 6/2010 | Yamamoto | B60Q 3/51 174/536 |
| 2011/0059632 | A1 * | 3/2011 | Bishop | H01R 4/2433 439/406 |
| 2012/0329309 | A1 * | 12/2012 | Weaver | H01R 4/242 439/404 |
| 2013/0130538 | A1 | 5/2013 | La Salvia | |
| 2013/0164968 | A1 | 6/2013 | Bishop et al. | |
| 2013/0224988 | A1 | 8/2013 | Bishop | |
| 2016/0218444 | A1 | 7/2016 | King, Jr. et al. | |

OTHER PUBLICATIONS

International Search Report and Written Opinion of the International Searching Authority for International Patent Application No. PCT/US2018/038450 dated Oct. 26, 2018, 11 pages.

* cited by examiner

ELECTRICAL POWER CONNECTION DEVICE

CROSS-REFERENCE TO RELATED APPLICATION

This application is a National Stage Application of PCT/US2018/038450, filed on Jun. 20, 2018, which claims the benefit of U.S. Patent Application Ser. No. 62/522,305, filed on Jun. 20, 2017, the disclosures of which incorporated herein by reference in their entireties. To the extent appropriate, a claim of priority is made to each of the above disclosed applications.

TECHNICAL FIELD

The present disclosure relates generally to devices for making electrical power connections.

BACKGROUND

In many fiber optic networks, an active device is desired to be installed at a physical location in the network where a local power source may not be readily available. Hybrid network architectures can use hybrid cables to provide optical connectivity and power services to a remote device in the network. Existing hybrid cables can include both optical fibers for carrying optical signals and electrical conductors for carrying power. The electrical conductors can include ground conductors and live/hot conductors. There is a need for a device that can safely access power from the electrical conductors without interrupting power to downstream devices at existing service locations.

SUMMARY

One aspect of the present disclosure relates to an electrical connection device for severing and making electrical contact with an insulated conductor. The electrical connection device includes an insulation displacement blade and a severing blade electrically connected to the insulation displacement blade. The severing blade and the insulation displacement blade are relatively positioned such that when the insulated conductor is installed within the electrical connector, the severing blade contacts an electrical conductor of the insulated conductor before the insulation displacement blade contacts the electrical conductor. The severing blade and the insulation displacement blade are also relatively positioned such that the insulation displacement blade makes electrical contact with the electrical conductor before the severing blade completely severs the electrical conductor. The pre-contact of the severing blade and its electrical connection with the insulation displacement blade allows the severing blade to function as a sacrificial part which prevents the insulation displacement blade from being damaged by electrical arcing. The contact of the insulation displacement blade with the electrical conductor before the electrical conductor is fully severed allows for electrical continuity to be maintained thereby avoiding downstream service interruption.

Another aspect of the present disclosure relates to an electrical connector including a dielectric body supporting an insulation displacement blade, and a cap for pressing an insulated conductor into the insulation displacement blade. To make an electrical connection with the insulated conductor, cap is forced toward the insulation displacement blade by an actuator such as a threaded fastener. The threaded fastener includes a pre-determined break location that breaks when the cap reaches a stop position in which the cap has fully pushed the insulated conductor into the insulation displacement blade. Thus, since it breaks, the threaded fastener cannot be used to retract the cap from the stop position. A head of the fastener can be captured relative to the cap. A latching arrangement can be used to hold the cap in the stop position. In one example, the latching arrangement can include a ratchet arrangement. In one example, the cap is permanently retained in the latched position. In one example, the cap is not removable from the dielectric body prior to actuation or after actuation.

DETAILED DESCRIPTION

Figure 1:
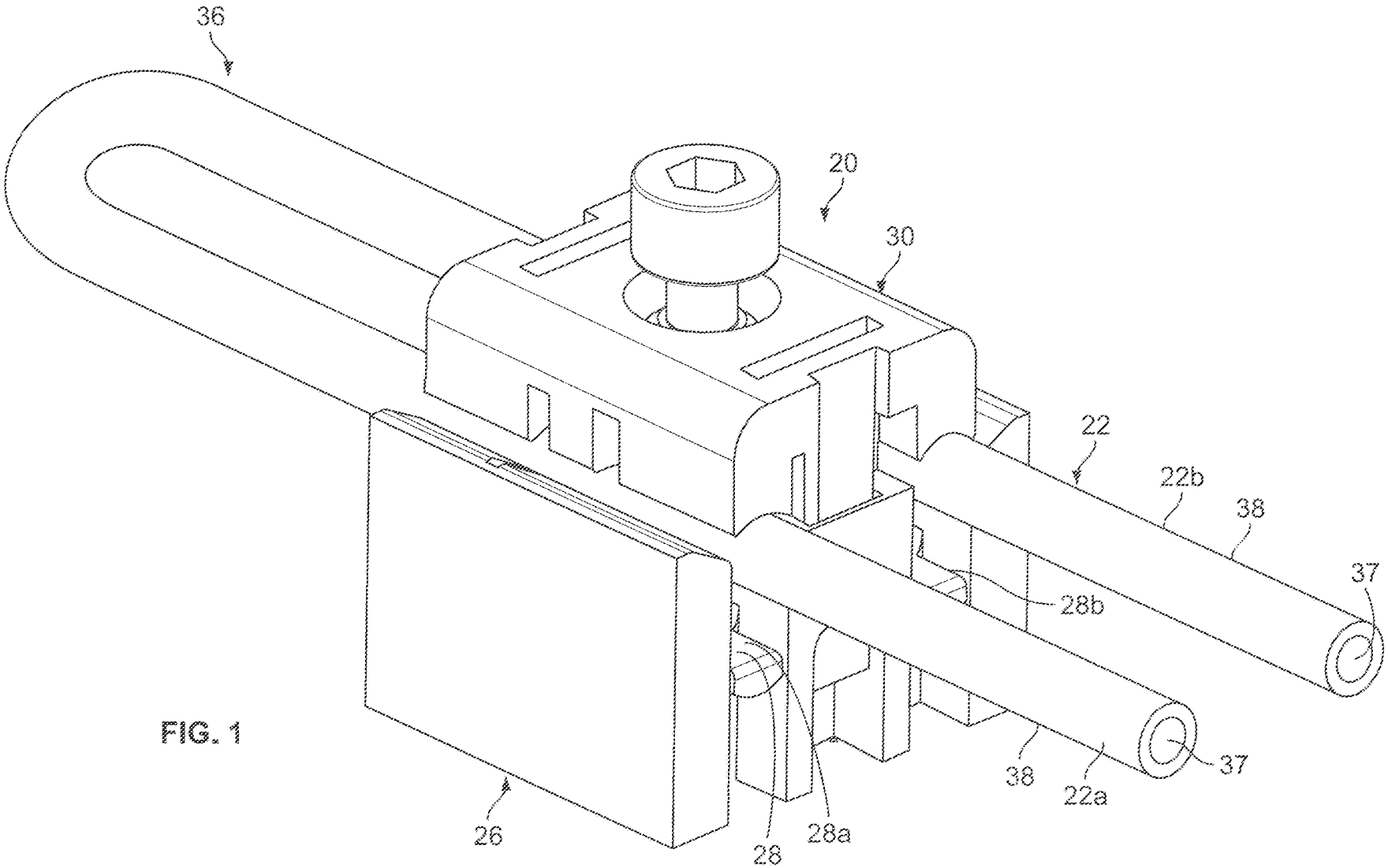
FIG. 1 is a perspective view of an embodiment of an electrical connector showing a cap in an open position.
Figure 2:
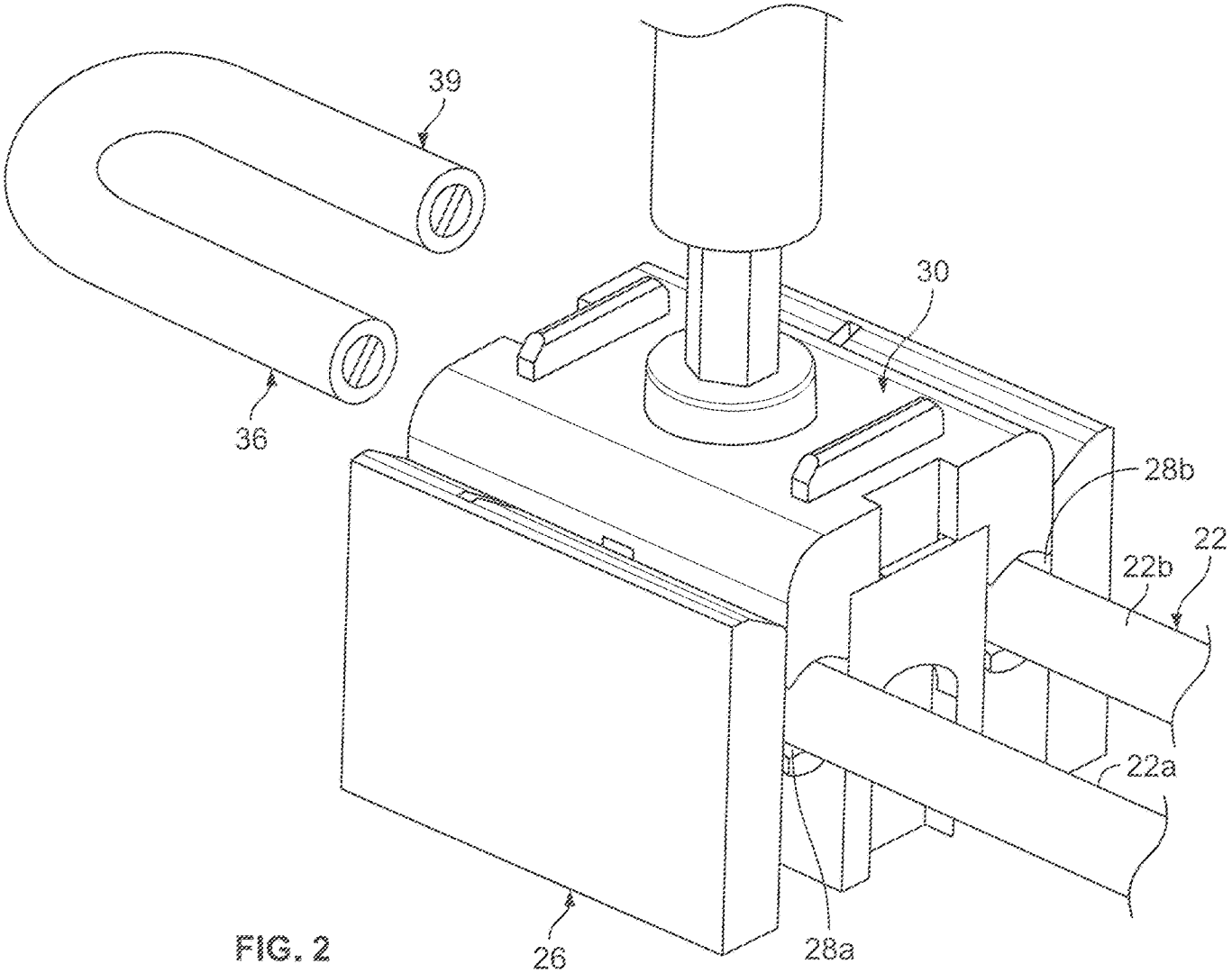
FIG. 2 is a perspective view showing the electrical connector of FIG. 1 with the cap in a closed position.
Figure 3:
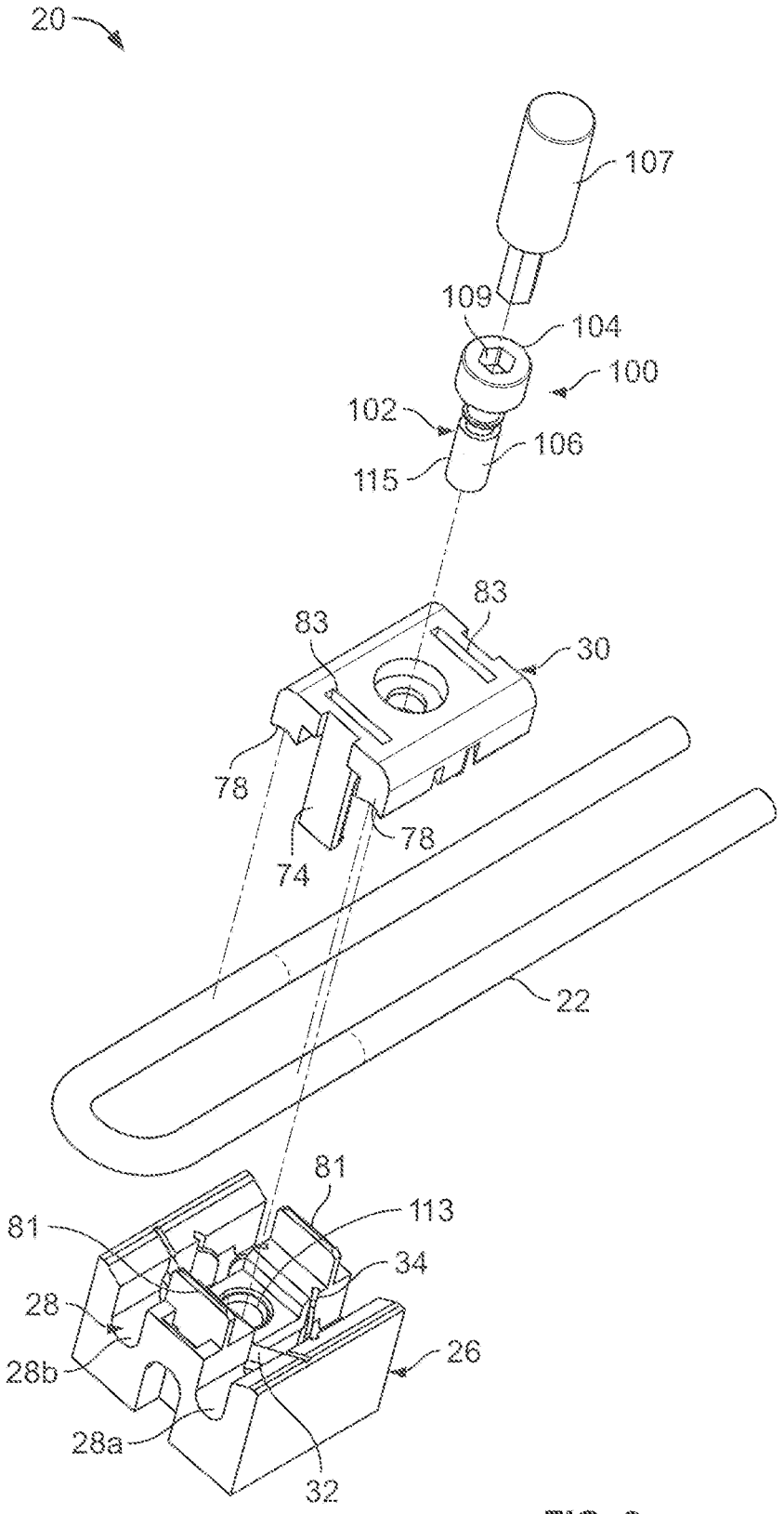
FIG. 3 is an exploded view of the electrical connector of FIG. 1

Aspects of the present disclosure relate to a device that can cut live (e.g., hot, active, powered, etc.) insulated electrical conductors (e.g., insulated electrical power conductors for carrying DC voltage that are part of a hybrid cable or a power cable or separate power cables) without cutting off power to downstream devices at existing service locations. To this end, aspects of the present disclosure relate to a device in which an insulation displacement blade contacts a conductive wire of a live cable prior to a blade completely severing the conductive wire. Also, aspects of the present disclosure relate to a device in which a cutting blade is electrically connected to an insulation displacement blade.

Aspects of the present disclosure also relate to a device that can safely cut live power insulated electrical conductors without exposing an installer to electric current flowing through the insulated conductors. To this end, aspects of the present disclosure relate to a device that includes a non-conductive cap that is not removable from the device. Also, to this end, aspects of the present disclosure relate to ensuring a cap of the device is irremovable from the device by using a threaded fastener with a structurally weak portion that causes the threaded fastener to break at a point when the cap is in a closed position.

Aspects of the present disclosure further relate to a device in which a cutting blade contacts a live electrical conductor of an insulated electrical conductor prior to an insulation displacement blade contacting the electrical conductor to avoid damage to the insulation displacement blade. Any arcing of direct current occurs on the blade rather than the insulation displacement connector.

FIGS. 1-11 depict an electrical connection device 20 in accordance with the principles of the present disclosure for severing and electrically connecting to a live insulated conductor 22. In one example, the device 20 includes a dielectric body 26 (e.g., a dielectric base) defining at least one channel 28 for receiving a section of the insulated conductor 22. The device 20 also includes a cap 30 (e.g., a dielectric cap) that mounts on the dielectric body 26. In a preferred example, the dielectric cap 30 is a push-down cap used to push the insulated conductor 22 into the channel 28. The cap 30 can be moved from an open position (see FIG. 1) where the insulated conductor 22 can be inserted in the channel 28 and a closed position (see FIG. 2) where the cap blocks finger access to any exposed electricity carrying features of the insulated conductor or the electrical connector. The device 20 also includes at least one severing blade 32 (see FIG. 3) mounted within the channel 28 for severing the insulated conductor 22 when the insulated conductor 22 is pressed into the channel 28 by the dielectric cap 30. The device 20 further includes an insulation displacement blade 34 (see FIG. 3) mounted in the channel 28 for piercing the insulation of the insulated conductor 22 and making an electrical connection with an electrical conductor of the insulated conductor 22 when the insulated conductor 22 is pressed into the channel 28 by the dielectric cap 30.

In one example, the severing blade 32 is electrically connected to the insulation displacement blade 34 and is positioned to make electrical contact with the electrical conductor of the insulated conductor 22 before the insulation displacement blade 34 makes electrical contact with the electrical conductor of the insulated conductor 22. In this way, the severing blade 32 can function as a sacrificial component that may be damaged by electrical arcing when initial electrical contact is made with the electrical conductor of the insulated conductor 22. This is particularly advantageous for electrical conductors that are carrying relatively high levels of direct current (DC) voltage. It is also preferred for the severing blade 32 and the insulation displacement blade 34 to be relatively positioned such that when the insulated conductor 22 is pressed into the channel 28 the insulation displacement blade 34 makes electrical contact with the electrical conductor of the insulated conductor 22 prior to the severing blade 32 completely severing the insulated conductor 22 to allow electrical continuity to be maintained/unbroken.

In certain examples, the insulated conductor 22 can be arranged in a loop 36 prior to loading the insulated conductor 22 into the device 20. As depicted at FIG. 1, when the insulated conductor 22 is arranged in the loop 36, the insulated conductor 22 defines two generally parallel insulated conductor sections 22*a*, 22*b*. The insulated conductor 22 includes an internal electrical conductor 37 typically having a construction that includes a conductive metal such as copper. The conductive metal can have a solid or stranded configuration. The insulated conductor 22 can also include an insulation layer 38 (e.g., a dielectric jacket, sheath, encasement, protective layer, etc.) that surrounds and encases the electrical conductor 37. The conductor section 22*a* can be connected to an upstream location (e.g., a central office, head-end or other source of power) and the conductor section 22*b* can be connected to downstream subscriber locations. When the cap 30 is moved to the fully closed position, an end 39 of the loop 36 is severed (see FIG. 2) from the remainder of the insulated conductor 22 by the severing blades 32.

The dielectric body 26 can also be described as a base and is preferably constructed of an electrically non-conductive material such as plastic. In one example, dielectric body is constructed as a block. In the depicted example, the dielectric body defines channels 28*a*, 28*b* that are preferably parallel to one another. The channels 28*a*, 28*b* each include an open upper end 40 and a closed lower end 42. The lower ends 42 can optionally be rounded. The channels 28*a*, 28*b* extend along parallel axes 44*a*, 44*b* (see FIG. 5).

Figure 4:
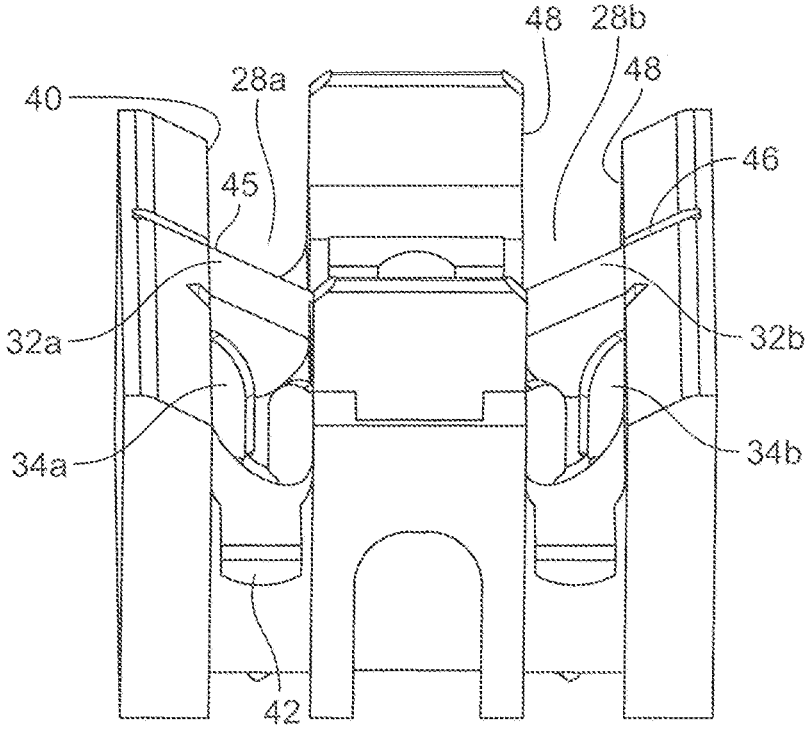
FIG. 4 is a perspective view of a base (e.g., dielectric body) of the electrical connector of FIG. 1.

Referring to FIG. 4, the device 20 includes two of the severing blades 32*a*, 32*b*. The severing blades 32*a*, 32*b* are each preferably made of an electrically conductive material such as metal. The severing blades 32*a*, 32*b* each include upwardly facing cutting edges 45 that extend across widths of the channels 28*a*, 28*b*. Side portions of the severing blades 32*a*, 32*b* are mounted within slots 46 defined in side walls 48 of the channel 28*a*, 28*b*. Base ends of the severing blades 32*a*, 32*b* can fit within slots that extend across the widths of the channels 28*a*, 28*b* and that are defined within the closed lower end 42 of each of the channels 28*a*, 28*b*. In certain examples, the severing blades 32*a*, 32*b* can be removed from the dielectric body 26 if it is not desired to sever the insulated conductor 22. In certain examples, the severing blades 32*a*, 32*b* can include conductive pins 50 (see FIGS. 6 and 8) that project downwardly through the dielectric body 26 and project outwardly from a bottom side of the dielectric body 26. In certain applications, the pins 50 can allow the severing blades 32*a*, 32*b* to electrically connect to electrical pathways (e.g., tracings) on a circuit board, to wires or to other structures for carrying electricity.

In certain examples, the cutting edges 45 of the severing blades 32*a*, 32*b* can be angled relative to horizontal such that the cutting edges 45 are higher at one of the side walls of each channel 28*a*, 28*b* as compared to the opposite side wall of each channel 28*a*, 28*b*. In the depicted example, the cutting edges 45 are higher adjacent an outer side wall as compared to an inner side wall of each channel 28*a*, 28*b*.

Figure 5:
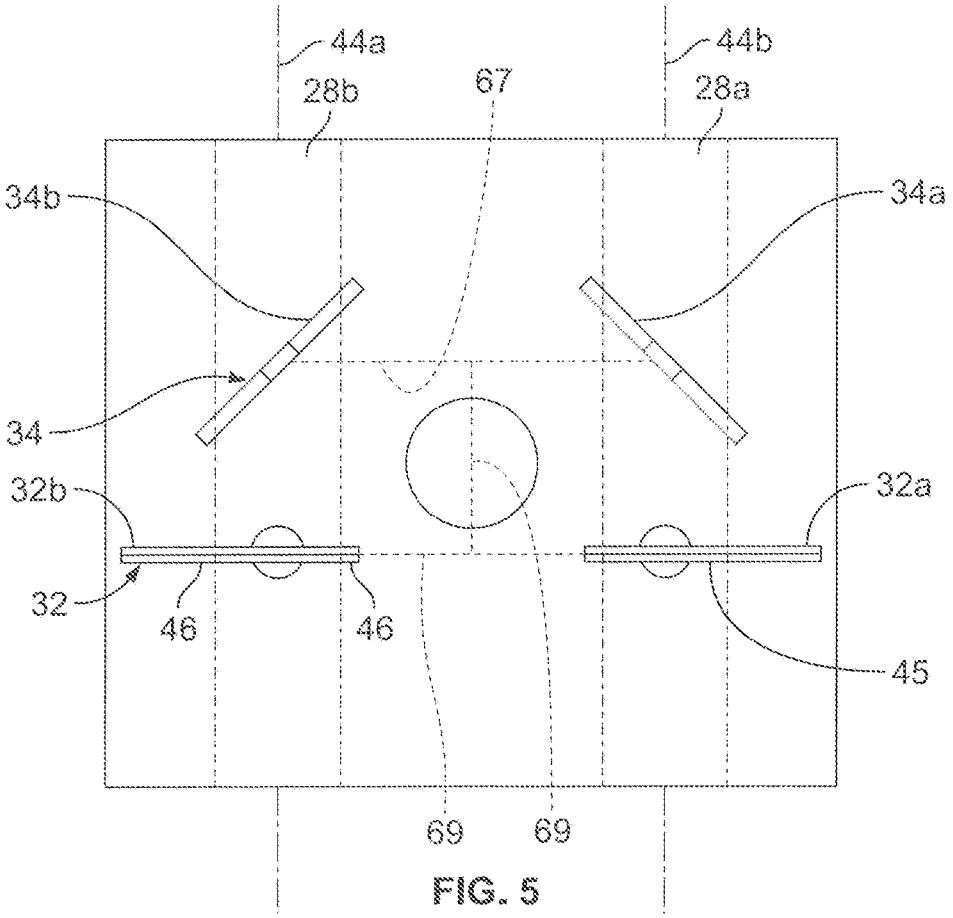
FIG. 5 is a schematic top plan view of the base of FIG. 4.
Figure 6:
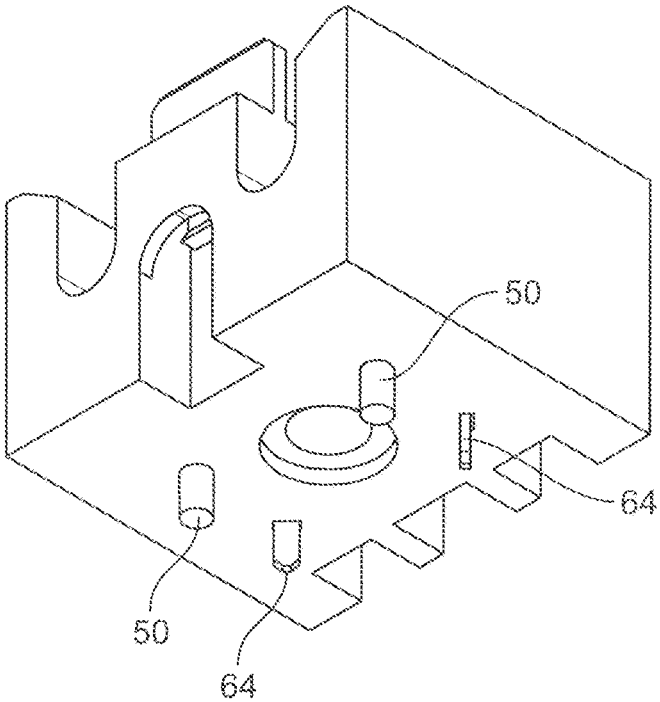
FIG. 6 is a perspective bottom view of the base of FIG. 4.
Figure 7:
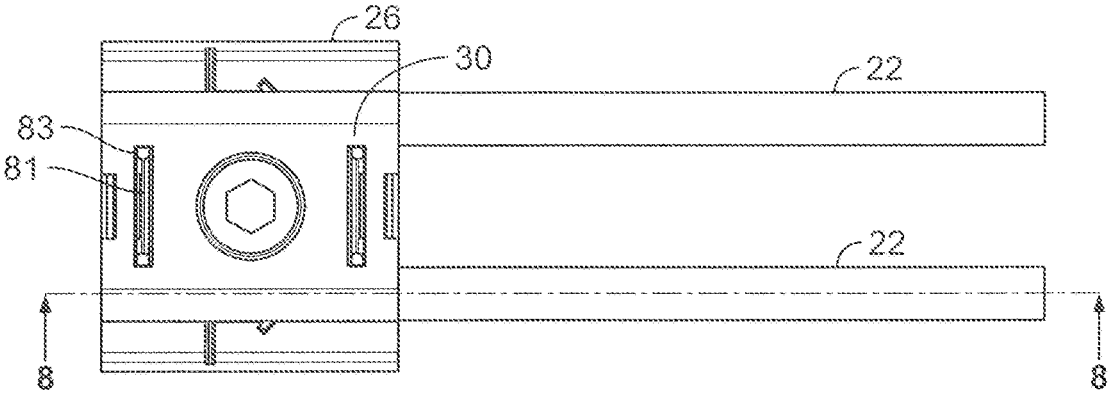
FIG. 7 is a top, plan view of the electrical connector of FIG. 1.
Figure 8:
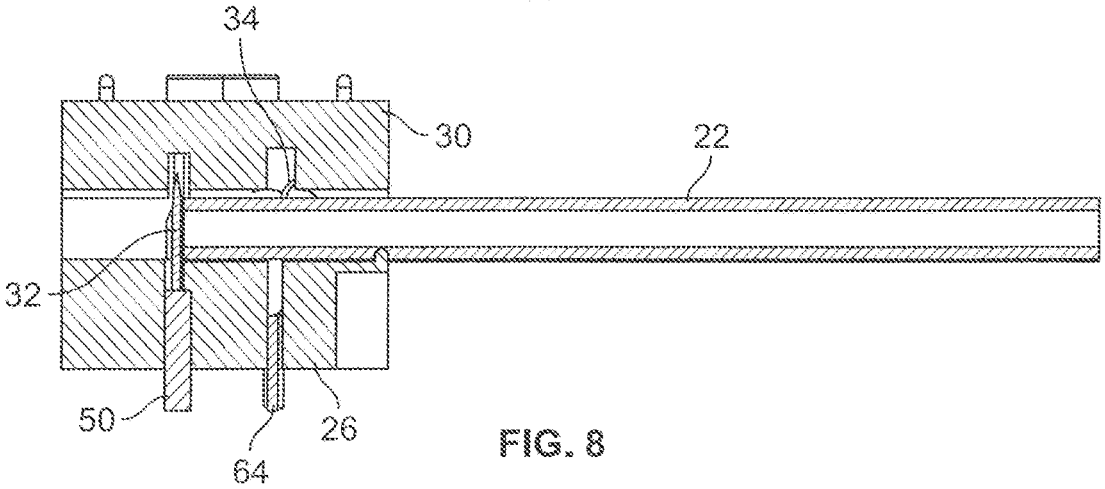
FIG. 8 is a cross-sectional view taken along section line 8-8 of FIG. 7.
Figure 9:
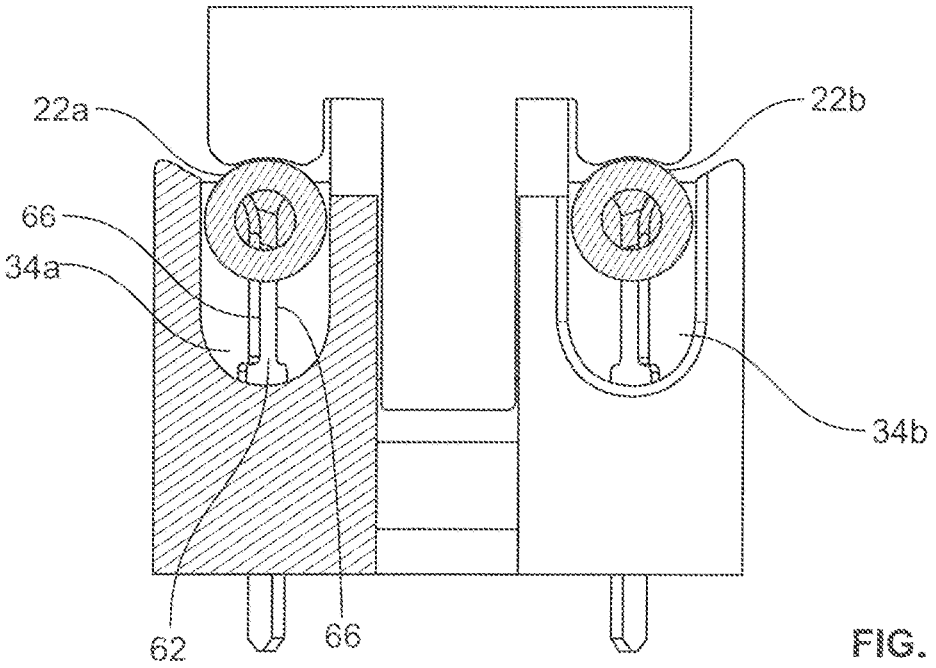
FIG. 9 is an end view of the electrical connector of FIG. 1.
Figure 12:
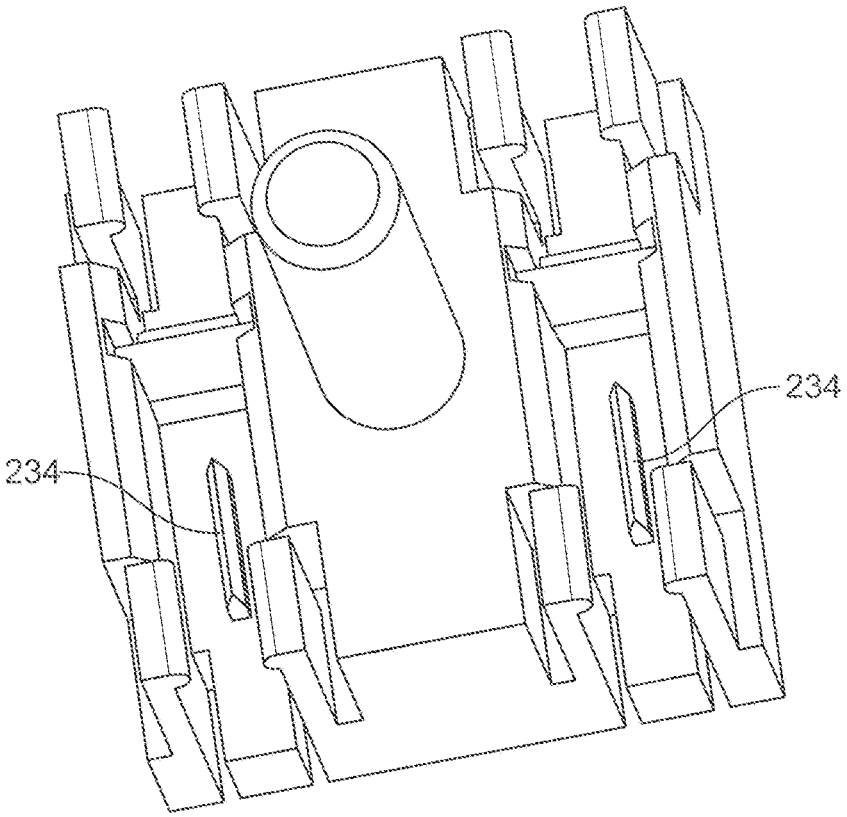
FIG. 12 is a perspective view showing an alternative electrical connector with an alternative insulation displacement blade.

Referring to FIG. 5, the device 20 includes two of the insulation displacement blades 34*a*, 34*b* each mounted in one of the channels 28*a*, 28*b* of the dielectric body 26. The insulation displacement blades 34*a*, 34*b* can also be referred to as insulation piercing blades. In the depicted examples, each of the insulation displacement blades 34*a*, 34*b* includes two opposing cutting edges 66 (see FIG. 9) separated by a slot 62 (see FIG. 9) for receiving the insulated conductor 22. The cutting edges 66 are configured to pierce/cut through the insulation layer 38 of the insulated conductor 22 and imbed within the electrical conductor 37 of the insulated conductor 22 when the insulated conductor 22 is pushed into the channels 28*a*, 28*b* by the dielectric cap 30. The cutting edges 66 preferably are separated by a spacing less than a diameter of the electrical conductor 37. In other examples, other configurations of insulation displacement blades can be used. For example, each insulation displacement blade may include only a single cutting edge. In this regard, FIG. 12 shows an alternative example having insulation displacement blades 234 having edges that are oriented parallel to the longitudinal axes of the channels. As used herein, an insulation displacement blade is any type of element suitable for piercing the insulation of an insulated conductor and making electrical contact with the electrical conductor contained within the insulated layer of the insulated conductor.

In the depicted example, the insulation displacement blades 34*a*, 34*b* are mounted within the channels 28*a*, 28*b* and are oriented at oblique angles relative to the longitudinal axes 44*a*, 44*b* of the channels 28*a*, 28*b*. Side portions of the insulation displacement blades 34*a*, 34*b* can be positioned within slots defined by the opposing side walls of the channels 28. In the depicted examples, the insulation displacement blades 34 include conductive pins or posts 64 that project downwardly through the dielectric body 26 and project outwardly from the bottom side of the dielectric body 26. The pins 64 allow the insulation displacement blades 34 to be readily connected to electrical pathways (e.g., tracings) a circuit board or to other means for conveying electricity.

As described above, the insulation displacement blades 34 are preferably positioned lower than the severing blades 32 such that the severing blades 32 make initial electrical contact with the electrical conductor 37 of the insulated conductor 22 prior to the insulation displacement blades 34 making electrical contact with the electrical conductor 37. In this way, at least one of the severing blades 32*a*, 32*b* can function as a sacrificial component in the event of arcing caused by initial contact with the electrical conductor 37. The cutting edges 66 of the insulation displacement blades 34 are also preferably positioned such that the insulation displacement blades 34 make electrical contact with the electrical conductor 37 before the severing blades 32 completely sever the insulated conductor 22 as the insulated conductor 22 is pressed into the channels 28*a*, 28*b* by the dielectric cap 30.

FIG. 5 is a schematic top view showing an example circuit diagram for the device 20. When the device 20 is mounted to a circuit board or otherwise electrically wired, the insulation displacement blades 34*a*, 34*b* are electrically connected to one another by conductive pathway 67. Also, the severing blades 32*a*, 32*b* are electrically connected to the insulation displacement blades 34*a*, 34*b* by conductive pathway 69. The conductive pathways 67, 69 can be provided by tracings on a circuit board. Alternatively, wiring or other electrical conductors can be used to make electrical connections between the two insulation displacement blades 34*a*, 34*b* and also can be used to electrically connect the severing blades 32*a*, 32*b* to the insulation displacement blades 34*a*, 34*b*.

In certain examples, the device 20 can be configured to limit or prevent the operator from having access to the electrical conductor 37 of the insulated conductor 22. In certain examples, the dielectric cap 30 is movable between an open position (see FIG. 1) where the insulated conductor 22 can be readily loaded into the channels 28*a*, 28*b*, and a closed position (see FIG. 2) where the dielectric cap 30 has pressed the insulated conductor 22 fully into the channels 28*a*, 28*b* causing the insulated conductor 22 to be severed and also causing an electrical connection between the insulated conductor 22 and the insulation displacement blades 34. It is preferred for the dielectric cap 30 to be permanently mounted on the dielectric body 26. In certain examples, the dielectric cap 30 is permanently mounted on and not removable from the dielectric body 26 when the dielectric cap 30 has been moved to the closed position. In another example, the dielectric cap 30 is not removable from the dielectric body 26 when the dielectric cap 30 is in the closed position and when the dielectric cap 30 is in the open position. In certain examples, dielectric cap 30 can only be removed from the dielectric body 26 by breaking the dielectric cap 30 and/or the dielectric body 26.

Figure 10:
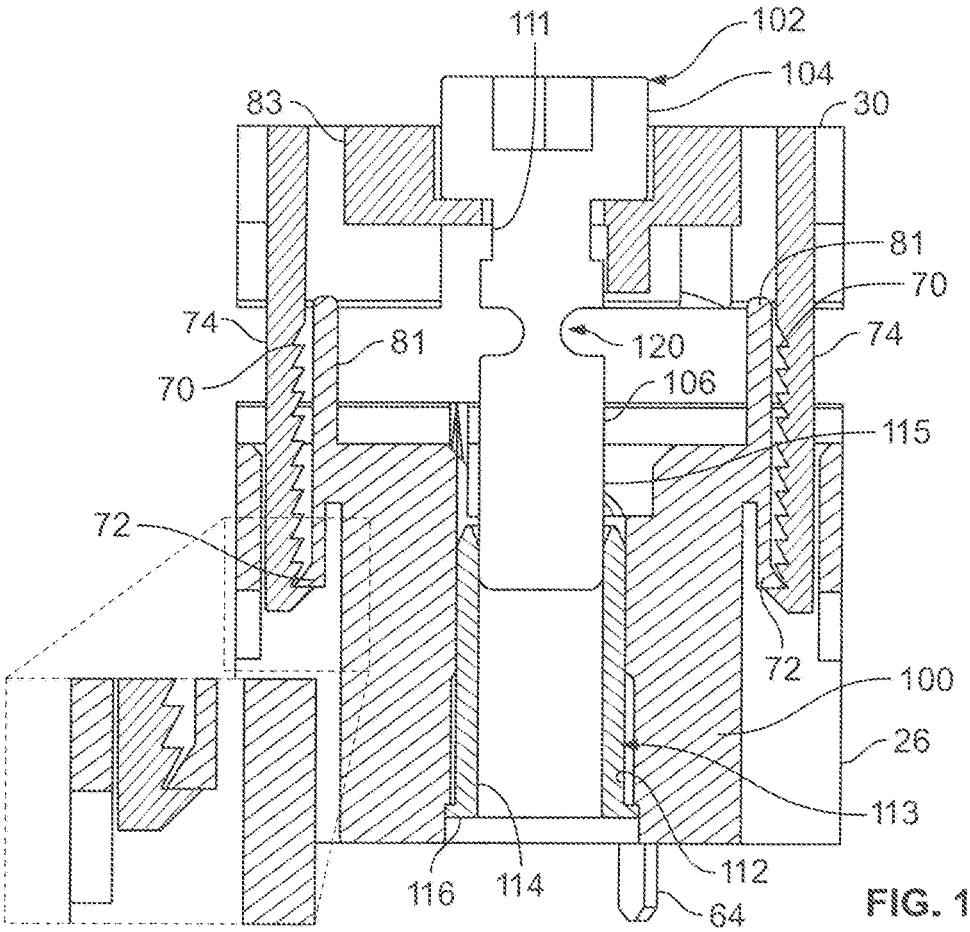
FIG. 10 is a cross-sectional view of the electrical connector of FIG. 1 shown in the open position.
Figure 11:
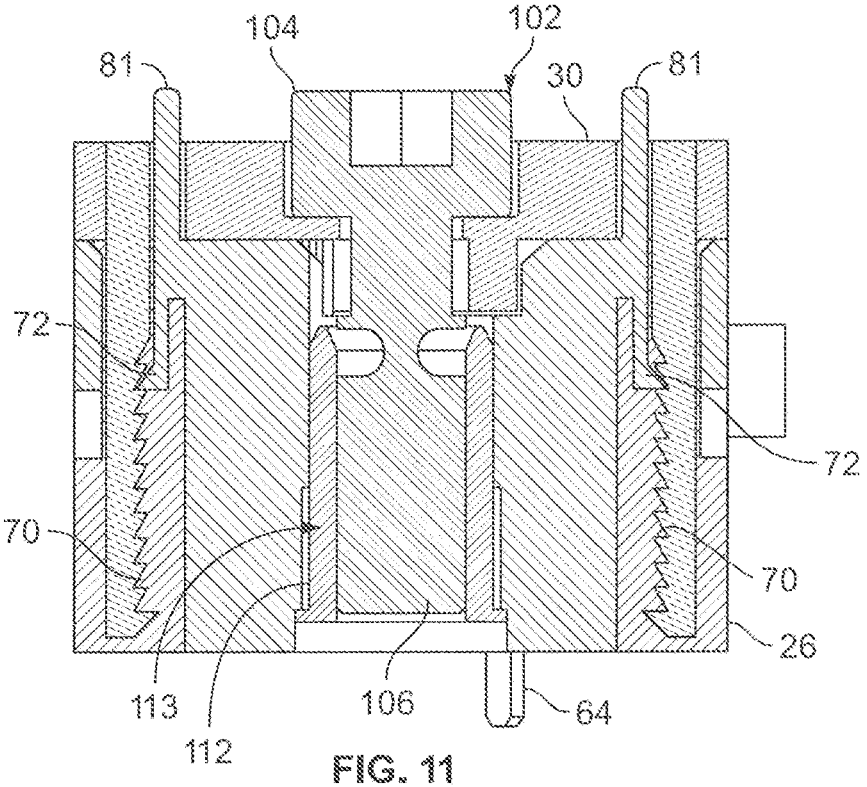
FIG. 11 is a cross-sectional view of the electrical connector of FIG. 1 shown in the closed position.

In certain examples, the device 20 can include a latching arrangement for securing the dielectric cap 30 in the closed position. In one example, the latching arrangement can include a ratchet arrangement. As depicted at FIGS. 10 and 11, the ratchet arrangement can include a plurality of ratchet teeth 70 that are engaged by the pawls 72. In certain examples, the ratchet teeth are provided on arms 74 that project downwardly from the main body of the dielectric cap 30. As the dielectric cap 30 is pressed downwardly, the pawls pass consecutive ratchet teeth 70 thereby locking the dielectric cap 30 in position and preventing the dielectric cap 30 from being moved away from the dielectric body 26. In certain examples, the arms 74 can slide within corresponding grooves or tracks defined by the dielectric body 26. The dielectric body 26 can also include guides 81 that slide within receivers 83 of the cap 30 (see FIG. 3). In certain examples, the dielectric cap 30 can be made of a non-conductive material such as plastic. In certain examples, the dielectric cap 30 can include pushing elements 78 that project downwardly from a main body of the dielectric cap 30 (see FIG. 3). The pushing elements 78 can extend along the lengths of the channels 28 and can include contoured lowered surfaces shaped to match the outer curvature of the insulated conductor 22. In certain examples, a mechanical interface between the pawls 72 and the ratchet teeth 70 prevents the dielectric cap 30 from being removed from the dielectric body 26 when the dielectric cap is in the open position, and when the cap is in the closed position.

In certain examples, the device 20 can include an actuating arrangement 100 for forcing, driving or otherwise moving the dielectric cap 30 towards the dielectric body from the open position to the closed position causing the insulated conductor 22 to be pressed within the channels 28. In the depicted example, the actuation arrangement includes a fastener. In certain examples, fastener can include a threaded fastener such as a bolt 102. The bolt 102 can include a head 104 and a threaded shank 106. The head 104 can be configured to receive or interface with a torque transferring element such as a wrench 107. For example, head 104 is shown including a receptacle 109 for receiving the wrench 107. The receptacle 109 can be configured for transferring torque and can include a socket with one or more internal flats (e.g., hexagonal shape, square shape, etc.) or splines or can comprise a screw driver receptacle. In other examples, the head 104 may include one or more exterior flats or other structures for allowing torque to be applied to the head 104.

As shown at FIG. 10, the bolt 102 includes an annular recess 111 beneath the head 104. A portion of the dielectric cap 30 (e.g., a collar) is molded into the recess 111 such that the bolt 102 is captured relative to the dielectric cap 30. In this way, the bolt 102 can freely rotate relative to the dielectric cap 30, but is not axially removable from the dielectric cap 30. Interference between the dielectric cap 30 and shoulders defining the recess 111 prevent the bolt 102 from being axially removed from the dielectric cap 30.

As shown at FIG. 10, when the dielectric cap 30 is in the open position, the pawls 72 engage the ratchet teeth 70 to prevent the dielectric cap 30 from being disengaged from the dielectric body 26. As shown at FIG. 11, when the dielectric cap 30 is in the closed position, the pawls 72 also engage the ratchet teeth 70 to prevent the dielectric cap 30 from being disengaged from the dielectric body 26, and prevent the cap 30 from being displaced from the closed position.

Referring to FIG. 10, the dielectric body 26 includes a central portion defining an engagement portion 113 adapted for mechanically interfacing with the bolt 102. In one example, the engagement portion 113 can include a threaded interface adapted to threadingly mate with the bolt. In one example, the engagement portion 113 can include a reinforcing insert 112 such as an internally threaded rivet having internal threads 114 adapted to mate with the external threads 115 on the shank 106 of the bolt 102. The insert 112 can include a rivet head having a flanged end 116 that prevents the rivet from pulling through the dielectric body 26. Additionally, the rivet can be mounted within a bore defined by the dielectric body 26 and an upper end of the rivet can oppose internal shoulders of the dielectric body 26 defined within the bore. In certain examples, the rivet is secured within the bore by a press-fit arrangement.

When the dielectric cap 30 is in the fully open position, the shank of the bolt is preferably sufficiently short or otherwise configured (e.g., an end of the bolt may be non-threaded) such that the threads of the bolt 102 preferably are not in engagement with the threads of the internally threaded insert 112. Thus, while the cap 30 is in the fully open position, if the bolt 102 is turned in a reverse direction, the cap 30 will not be forced off the dielectric body 26 by engagement between the bolt and the threaded interface of the dielectric body 26. To drive the cap 30 toward the closed position using the bolt 102, the cap 30 can initially be manually pressed a relatively short distance toward the closed position to an intermediate position where the threads of the bolt 102 engage with the internal threads of the insert 112. The bolt 102 is then turned/rotated in a forward direction (e.g., using the wrench 107), such that threads of the bolt 102 thread into the internal threads of the reinforcing insert 112 causing the dielectric cap 30 to be pulled/drawn axially downwardly toward the dielectric body 26. As the dielectric cap 30 is pulled axially downwardly by rotation of the bolt 102, the insulated conductor 22 is pressed down against the severing blades 32 and the insulation displacement blades 34. The bolt 102 is driven in the forward direction until the dielectric cap 30 moves fully from the open position to the closed position in which the severing blades 32 sever the insulated conductor 22 and the insulation displacement blades 34 have made electrical contact with the insulated conductor 22. As described above, the contact between the insulated conductor 22 and the blades 32, 34 is preferably sequenced such that: a) the severing blades 32 make initial electrical contact with the electrical conductor of the insulated conductor 22 before the insulation displacement blades 34 make electrical contact with the electrical conductor; and b) the cutting edges of the insulation displacement blades 34 make electrical contact with the electrical conductor of the insulated conductor 22 before the insulated conductor 22 is fully severed by the severing blades 32.

As shown at FIG. 10, the bolt 102 can include a pre-defined break location 120 having a reduced cross-sectional area as compared to the remainder of the shank. The pre-defined break location 120 is preferably positioned between the annular recess 111 and the main threaded portion of the shank 106. The pre-defined break location 120 can be formed by a notch, groove or other type of intermediate size reduction in the shank 106 of the bolt 102. When the bolt 102 has moved the dielectric cap 30 to the closed position (e.g., a stop position, final position, installed position, etc.) where the insulated conductor 22 has been severed and the cutting edges of the insulation displacement blades 34 are embedded in or otherwise in contact with the electrical conductor of the insulated conductor 22, the threaded shank 106 of the bolt 102 can bottom-out in the threaded interface of the dielectric body 26 causing an increase or spike in torque from the driver 107 with the increase or spike in torque being sufficient to cause the bolt 102 to break at the pre-defined break location 120. The closed position can also coincide with the cap 30 bottoming-out (e.g., contacting/engaging a positive stop) on the dielectric body 26. Once the bolt 102 has broken at the pre-defined break location 120, the head 104 of the bold 102 can spin freely relative to the cap 30 without turning the main threaded portion of the shank 106. In this way, the ratchet arrangement holds the cap 30 in the closed position, and the bolt 102 cannot be used to force the cap 30 off of the dielectric body 26. The pre-defined break location is below the location where the head 104 is captured relative to the cap 30. Thus, the head 104 remains captured and attached relative to the cap 30 after the bolt 102 has broken at the pre-defined break location 120.

In use of the electrical connection device 20, the cap 30 is initially positioned in the fully open position. With the cap 30 in the fully open position, the insulated conductor 22, while in the looped configuration 36, is loaded into the electrical connection device 20. For example, the conductor portion 22*a* (which coupled to an upstream extent of the insulated conductor 22) is maneuvered under the raised cap 30 and into the channel 28*a* and the conductor portion 22*b* (which is coupled to a downstream extent of the insulated conductor) is maneuvered under the raised cap 30 into the channel 28*b*. Once the conductor portions 22*a*, 22*b* are in their respective channels 28*a*, 28*b*, the cap is pushed down to the intermediate position to bring the threaded shank 106 of the bolt 102 into engagement with the internally threaded interface of the engagement portion 113 of the body 26. The bolt 102 is then driven in a forward rotational direction (e.g., clockwise) causing the cap 30 to be forced axially toward the dielectric body 26. As the cap 30 is forced toward the dielectric body 26, the cap 30 forces the conductor portions 22*a*, 22*b* downwardly into their respective channels 28*a*, 28*b*. The conductor portions 22*a*, 22*b* are forced against the severing blades 32 and the insulation displacement blades 34 as the cap presses the conductor portions 22*a*, 22*b* into the channels 28*a*, 28*b*. The severing blades 32*a*, 32*b* cut through the insulation of the conductor portions 22*a*, 22*b* and make initial contact with the electrical conductors of the conductor portions 22*a*, 22*b* before the edges of the insulation displacement blades 34*a*, 34*b* contact the electrical conductors. However, since the severing blades 32*a*, 32*b* are electrically connected to the insulation displacement blades 34*a*, 34*b* by the electric path/paths 67, 69, the insulation displacement blades 34*a*, 34*b* are also electrically connected to the electrical conductors of the conductor portions 22*a*, 22*b*. Since the severing blades 32 make initial direct contact, they may be exposed to arcing damage, but can be considered as sacrificial parts. As the conductor portions 22*a*, 22*b* are pushed further into the channels, the edges of the insulation displacement blades 34*a*, 34*b* make contact with the electrical conductors of the conductor portions 22*a*, 22*b*. Since the insulation displacement blades 34*a*, 34*b* have already been electrically connected to the electrical conductors via the severing blades 32 and the electric paths 67, 69, the insulation displacement blades 34*a*, 34*b* do not experience arcing damage. Preferably, the edges of the insulation displacement blades 34*a*, 34*b* make electrical contact with the electrical conductors of the conductor portions 22*a*, 22*b* before the loop 36 is severed off by the severing blades 32*a*, 32*b*. Thus, prior to the loop 36 being severed, the conductor portions 22*a*, 22*b* are electrically connected together by the insulation displacement blades 34*a*, 34*b* and the electrically conductive pathway 67 that electrically connects the insulation displacement blades 34*a*, 34*b* together. Thus, through the use of the conductive pathway 67 between the insulation displacement blades 34*a*, 34*b*, upstream-to-downstream electrical continuity is maintained between the conductor portions 22*a*, 22*b* thereby preventing power from being disrupted to downstream subscribers when the electrical connection device is installed.

Figure 13:
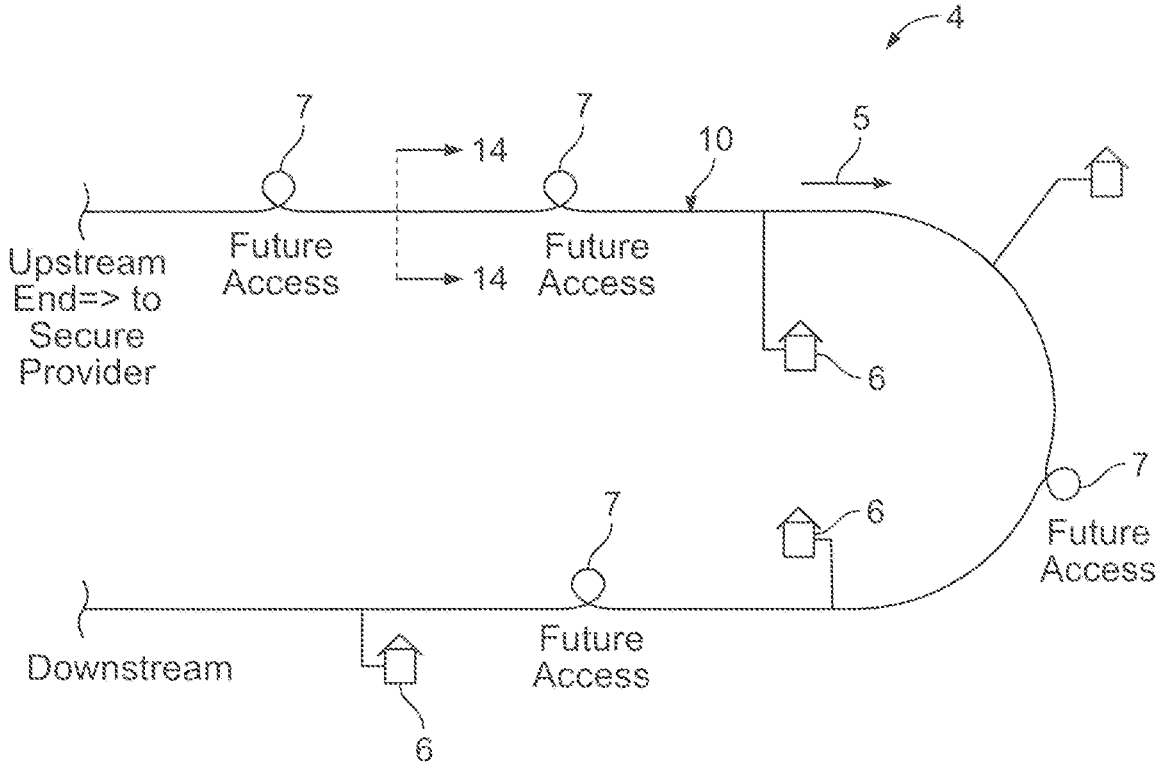
FIG. 13 schematically shows an example network architecture including a hybrid cable.

FIG. 13 shows an example optical fiber network 4 using a hybrid cable 10. The hybrid cable 10 extends in an upstream-to-downstream direction (see arrow 5). An upstream end of the hybrid cable 10 is typically connected to a service provider location (e.g. a central office, head-end, hub, or other location) and the hybrid cable can be routed in the vicinity of subscriber locations 6 as it extends in the downstream direction. Future access locations 7 (e.g., loops with stored cable length for future access) can be provided along the length of the hybrid cable 10.

Figure 14:
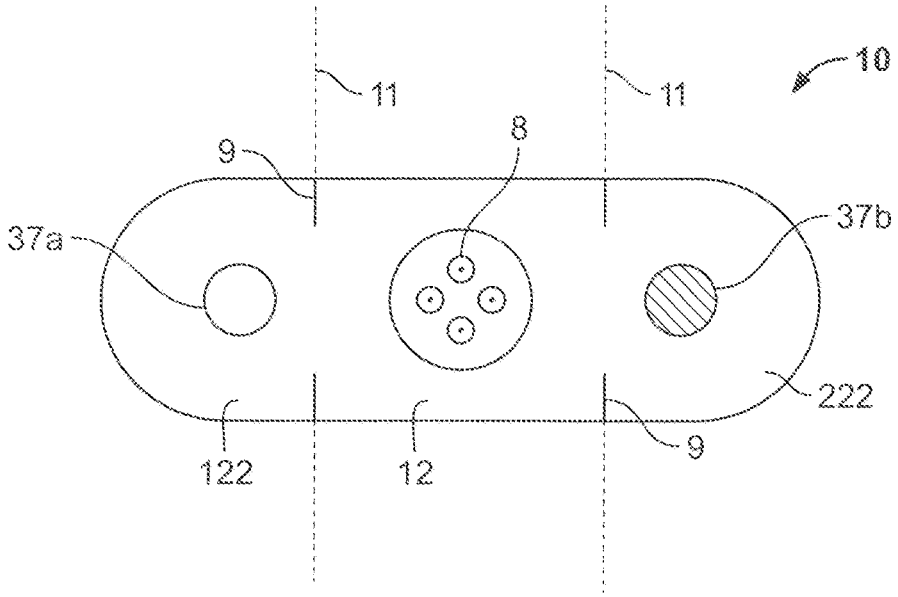
FIG. 14 is a cross-sectional view taken along section line 14-14 of FIG. 13 showing an example hybrid cable.

FIG. 14 is a cross-sectional view of an example version of the hybrid cable 10. Thy hybrid cable 10 is depicted having a central portion containing optical fibers 8, and side portions containing electrical conductors 37*a*, 37*b*. The hybrid cable 10 includes weakened portions 9 that allow the hybrid cable 10 to be separated at lines 11 into a central fiber portion 12 containing the optical fibers 8, a left insulated conductor 122 containing one of the electrical conductors 37*a* and a right insulated conductor 222 containing the other one of the electrical conductors 37*b*. The optical fibers 8 and each of the electrical conductors 37*a*, 37*b* are contained within separate sheaths or layers of jacket insulation material. One of the electrical conductors 37*a* can be connected to an electrical power source (e.g., AC power or DC power so as to be live/hot/powered) and the other of the electrical conductors 37*b* can be neutral or connected to ground.

Figure 15A:
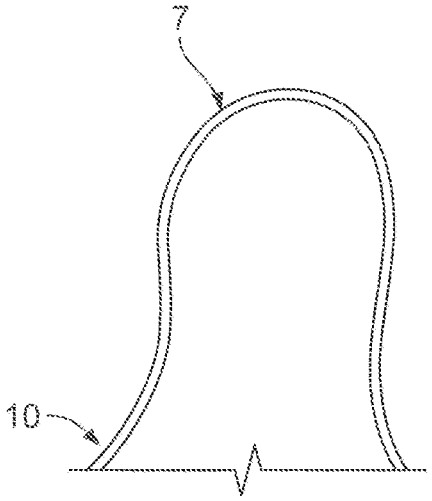
FIGS. 15A-E shows a sequence of steps for preparing a hybrid cable for connection and for managing the prepared hybrid fiber optic cable.
Figure 15B:
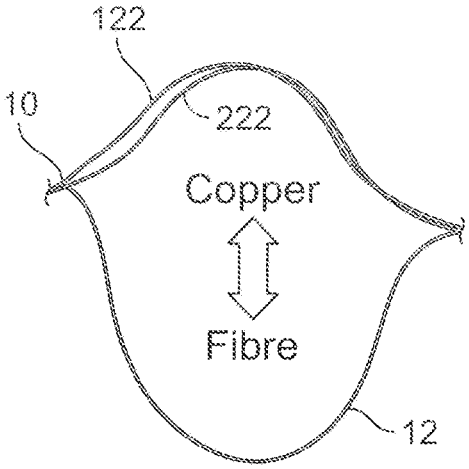
Figure 15C:
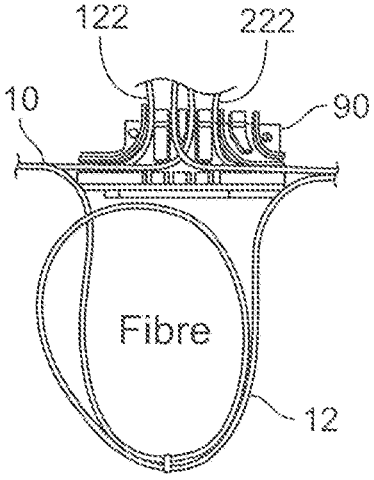
Figure 15D:
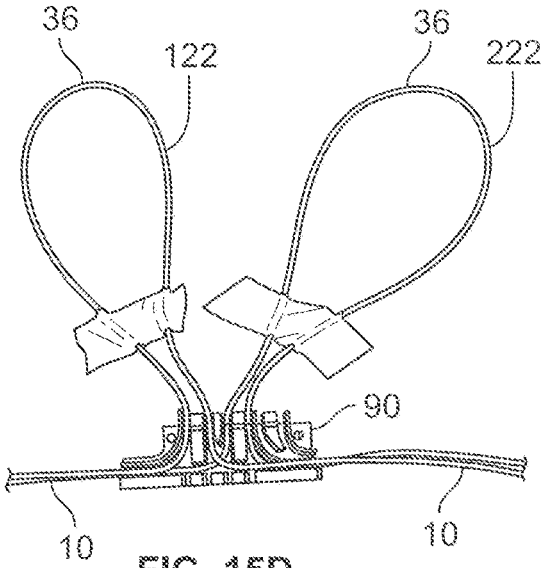
Figure 15E:
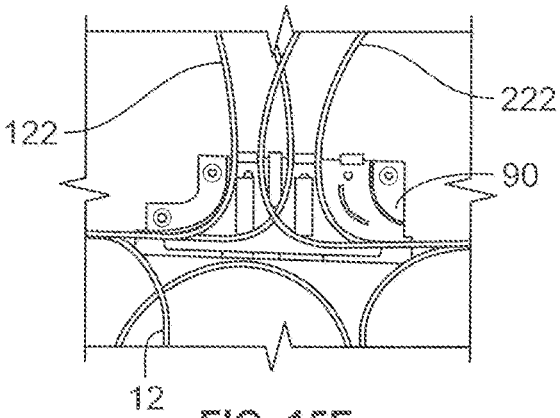

FIGS. 15A-E show a sequence of steps for preparing one of the future access locations 7 of the hybrid cable 10 for connection to an active device at a subscriber location. FIG. 15A shows a section of the hybrid cable 10 at the future access location 7 prior to the hybrid cable 10 being separated apart at lines 11. FIG. 15B shows the hybrid cable 10 after the section of the hybrid cable 10 at the future access location 7 has been separated apart at the lines 11 into the central fiber portion 12, the left insulated conductor 122 and the right insulated conductor 222. FIG. 15C shows the left insulated conductor 122 and the right insulated conductor 222 routed to a manager 90 that routes the left insulated conductor 122 and the right insulated conductor 222 into separate loops 36 (see FIG. 15D). FIG. 15E is an enlarged view of routing paths of the cable manager 90.

Figure 16:
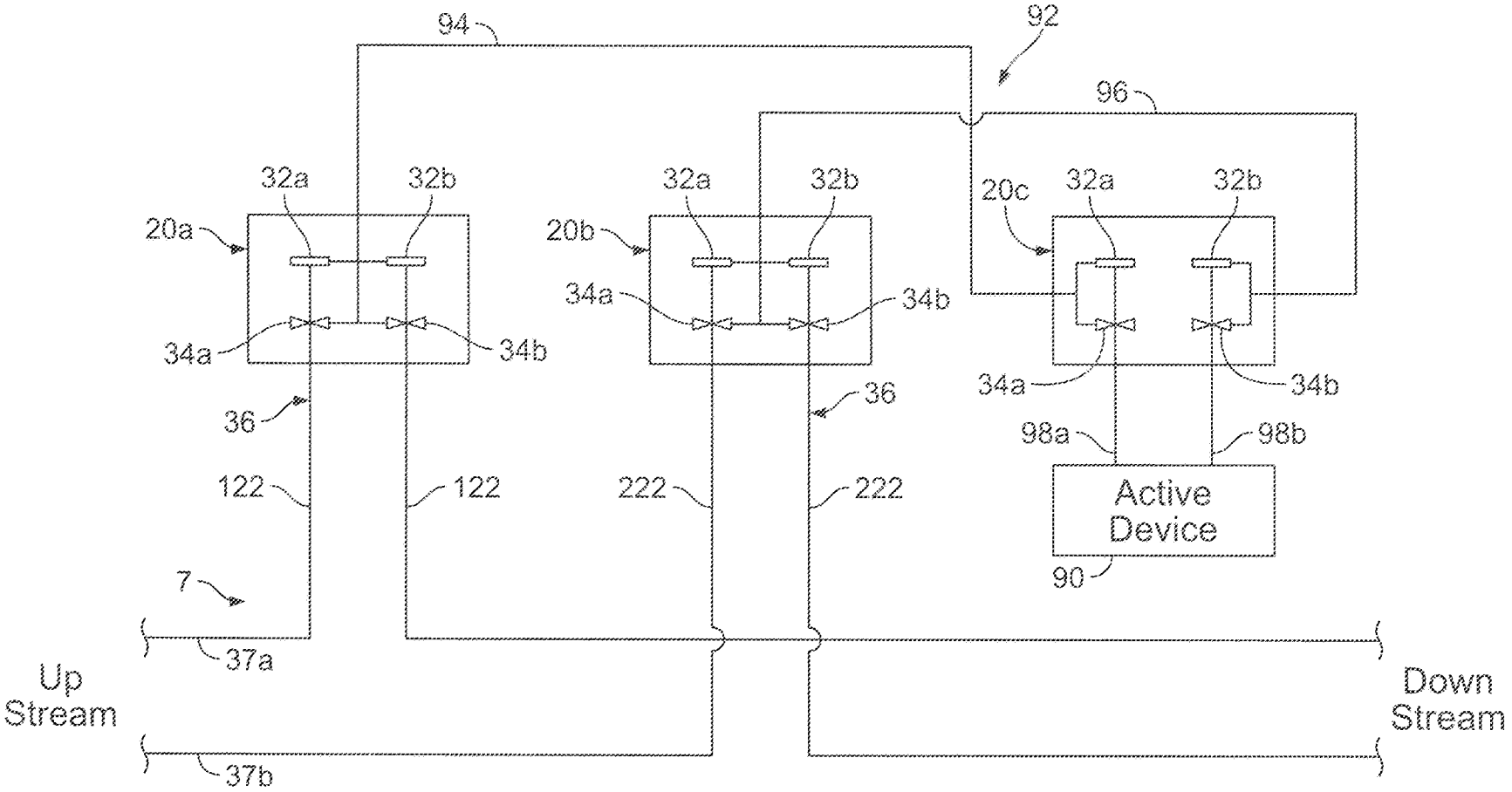
FIG. 16 is a schematic view of an example termination lay-out for using electrical connectors in accordance with the principles of the present disclosure to access power at an access location of a hybrid fiber optic cable.

FIG. 16 schematically shows a connection arrangement 92 for electrically connecting the left and right conductors 122, 222 of the prepared future access location 7 of FIGS. 15A-15E to an active device 90 at a subscriber location 6 to provide power to the active device 90. It will be appreciated that one or more of the optical fibers 8 (not shown at FIG. 16) of the hybrid cable 10 can also be accessed at the future access location 7 and coupled to the active device 90 to provide optical communication services. The connection arrangement 92 includes three of the electrical connection devices 20 which have been assigned reference numbers 20*a*, 20*b* and 20*c*. The connection devices 20*a*, 20*b* and 20*c* can have the same construction as the device 20 described above, except the insulation displacement blades 34*a*, 34*b* of the device 20*c* are not electrically connected together. The insulation displacement blades 34*a*, 34*b* of the electrical connection device 20*a* are electrically connected to the insulation displacement blade 34*a* of the electrical connection device 20*c* by conductive line 94. The insulation displacement blades 34*a*, 34*b* of the electrical connection device 20*b* are electrically connected to the insulation displacement blade 34*b* of the electrical connection device 20*c* by conductive line 96. In one example, the electrical connection devices 20*a*, 20*b*, 20*c* can be mounted on the same circuit board to provide the depicted electrical connections therebetween, or can be electrically connected together by other means such as wires. The left insulated conductor 122 has been connected to the connection device 20*a* to electrically connect the electrical conductor 37*a* of the hybrid cable 10 to the insulation displacement blade 34*a* of the connection device 20*c* while maintaining electrical continuity in an upstream-to-downstream direction along the electrical conductor 37*a*. The right insulated conductor 222 has been connected to the connection device 20*b* to electrically connect the electrical conductor 37*b* of the hybrid cable 10 to the insulation displacement blade 34*b* of the connection device 20*c* while maintaining electrical continuity in an upstream-to-downstream direction along the electrical conductor 37*b*. Insulated conductors 98*a*, 98*b* can be installed in the connection device 20*c* to respectively couple the electrical conductors 37*a*, 37*b* to the active device 90. In one example, the access location 7 is provided at day one (e.g., when the cable 10 is initially installed) and the electrical connection devices 20*a*, 20*b*, 20*c* are installed at day two (e.g., at a later/future date when a subscriber is in need of service). In other examples, the conductive lines 94, 96 can be routed directly to the active device 90 without using the connection device 20*c*. In a further example, the electrical connection devices 20*a*, 20*b* can be coupled to the insulated conductors 122, 222 at day one, and the insulated conductors 98*a*, 98*b* can be coupled to the electrical connection device 20*c* at day two when it is desired to couple the active device 90 to the network.

Aspects of the present disclosure relate to an electrical connection device comprising: a base or body having a channel; and/or a base or body having a plurality of channels; and/or an insulation displacement blade within the channel; and/or insulation displacement blades positioned within the channels; and/or a severing blade positioned within the channel; and/or severing blades positioned within the channels; and/or a cap for pressing an insulated conductor into the channel or channels; and/or a severing blade being electrically connected to an insulation displacement blade and being configured to contact an electrical conductor of the insulated conductor prior to a cutting edge of the insulation displacement blade contacting the electrical conductor; and/or the cap being permanently connected to the base; and/or the cap being connected to the base by a ratchet arrangement; and/or the cap being moveable between an open position and a closed position and being coupled to the base by a latch arrangement that prevents the cap from being displaced from the closed position once the cap is in the closed position; and/or the latch arrangement including a ratchet; and/or the cap being moved relative to the base by a threaded fastener; and/or the threaded fastener having a break-away head; and/or the threaded fastener having a predetermined break-location between a head and a shank at which the fastener breaks when the cap reaches the closed position; and/or the head being captured relative to the cap;

and/or the threaded fastener not engaging a threaded interface of the base when the cap is in a fully open position; and/or the base including sets of insulation displacement and severing blades in adjacent channels with the insulation displacement blades being electrically connected together and the severing blades configured to contact an electrical conductor of an insulated conductor pressed into the channels prior to cutting edges of the insulation displacement blades contacting the electrical conductor and the cutting edges of the insulation displacement blades contacting the electrical conductor before the severing blades sever the electrical conductor.

As used herein, the term "insulation displacement blade" refers to an element made of a conductive material that can cut or pierce through an insulation layer of an insulated electrical conductor and make electrical contact with the electrical conductor.

From the foregoing detailed description, it will be evident that modifications and variations can be made to the device disclosed herein without departing from the spirit or scope of the disclosure.

What is claimed is:

1. An electrical connection device for connecting to an insulated conductor including an electrical conductor surrounded by insulation material, the electrical connection device comprising:

a dielectric body having at least one channel for receiving the insulated conductor;

a cap made of a non-conductive material that is movable in relation to the dielectric body between an open position and a closed position;

a severing blade made of a conductive material extending across the at least one channel; and at least one insulation displacement blade in the at least one channel;

wherein the cap pushes the insulated conductor into the severing blade and the at least one insulation displacement blade as the cap moves from the open position to the closed position;

wherein the severing blade is electrically connected to the at least one insulation displacement blade;

wherein the severing blade is located in the at least one channel such that it contacts the electrical conductor of the insulated conductor prior to a cutting edge of the at least one insulation displacement blade contacting the electrical conductor as the cap is moved from the open position to the closed position; and wherein the at least one insulation displacement blade is located in the at least one channel such that its cutting edge contacts the electrical conductor of the insulated conductor prior to the severing blade completely severing the electrical conductor as the cap is moved from the open position to the closed position.

2. The device of claim 1, wherein when the cap is in the open position, the insulated conductor can be maneuvered under the cap and into the at least one channel.

3. The device of claim 1, wherein the severing blade is removable from the at least one channel.

4. The device of claim 1, wherein the at least one channel has an open top and a closed bottom.

5. The device of claim 1, wherein the dielectric body defines a pair of the channels each containing the severing blade and the insulation displacement blade, and wherein the insulation displacement blades are electrically connected to each other.

6. The device of claim 5, wherein longitudinal axes of the pair of channels are parallel to one another.

7. The device of claim 1, wherein a latch arrangement connects the cap to the dielectric body, and wherein an actuator is used to move the cap from the open position to the closed position.

8. The device of claim 7, wherein the latch arrangement prevents the cap from being removed from the dielectric body when the cap is in the open position, and the latch arrangement prevents the cap from being displaced from the closed position when the cap is in the closed position.

9. The device of claim 7, wherein the actuator includes a bolt having a head and a threaded shank, and wherein the threaded shank is adapted to thread within a threaded interface of the dielectric body to draw the cap toward the dielectric body.

10. The device of claim 9, wherein the bolt has a pre-determined break location between the head and the threaded shank, and wherein the head breaks from the shank at the pre-determined break location when the cap reaches the closed position.

11. The device of claim 9, wherein the threaded interface is defined by an internally threaded insert mounted within a main body of the dielectric body.

12. The device of claim 10, wherein the head is captured relative to the cap so as to not disengage from the cap when the bolt breaks at the pre-determined break location.

13. The device of claim 9, wherein the threaded shank does not engage the threaded interface when the cap is in the open position.

14. The device of claim 7, wherein the latch arrangement includes a ratchet and pawl arrangement.

15. An electrical connection device for connecting to an insulated conductor including an electrical conductor surrounded by insulation material, the electrical connection device comprising:

a dielectric body having at least one channel for receiving the insulated conductor;

a cap made of a non-conductive material that is movable in relation to the dielectric body between an open position and a closed position;

at least one insulation displacement blade in the at least one channel; and a threaded fastener having exterior threads and a threaded structure having interior threads mating with the exterior threads of the threaded fastener, the threaded fastener extending through the cap and the threaded structure being located in the dielectric body, wherein the threaded fastener has a structurally weak portion along a shank of the threaded fastener that causes a head of the threaded fastener to break away when the threaded fastener is threaded into the threaded structure to a point that the cap is in the closed position.

16. The device of claim 15, wherein the threaded fastener is a bolt.

17. The device of claim 15, wherein the threaded structure is a rivet nut.

18. The device of claim 15, wherein the structurally weak portion is a circumferential notch in the shank.

19. The device of claim 15, wherein the head is captured by the cap when it breaks away.

20. The device of claim 19, wherein the threaded fastener comprises a notch on the shank that engages a collar on the cap.

21. The device of claim 15, wherein a lower portion of the shank of the threaded fastener is free of the exterior threads and does not engage the threaded structure in the dielectric body when the cap is in the open position.

* * * * *